US006154995A

United States Patent [19]

Lenoir et al.

[11] Patent Number: 6,154,995

[45] Date of Patent: Dec. 5, 2000

[54] TRIGGER COVER FOR FIREARM

[76] Inventors: Richard C. Lenoir, 2 Ezell Rd., Purvis, Miss. 39475; Mark D. Kenney, 1014 Barkwood, Safety Harbor, Fla. 34695

[21] Appl. No.: 09/287,785

[22] Filed: Apr. 7, 1999

[51] Int. Cl.[7] ..... F41A 17/46

[52] U.S. Cl. ..... 42/70.07

[58] Field of Search ..... 42/70.07, 70.11, 42/70.06, 70.01

[56] References Cited

U.S. PATENT DOCUMENTS

| | | | |
|---|---|---|---|
| 3,939,679 | 2/1976 | Barker et al. | 70/277 |
| 4,488,370 | 12/1984 | Lemelson | 42/70 R |
| 5,012,605 | 5/1991 | Nishioka | 42/70.07 |
| 5,062,232 | 11/1991 | Eppler | 42/70.11 |
| 5,138,786 | 8/1992 | Fischer | 42/70.11 |
| 5,168,114 | 12/1992 | Enget | 42/70.01 |
| 5,283,971 | 2/1994 | Fuller et al. | 42/70.07 |
| 5,392,552 | 2/1995 | McCarthy et al. | 42/70.07 |
| 5,419,068 | 5/1995 | Pages et al. | 42/70.07 |
| 5,461,812 | 10/1995 | Bennett | 42/70.11 |
| 5,487,234 | 1/1996 | Dragon | 42/70.07 |
| 5,560,135 | 10/1996 | Ciluffo | 42/70.07 |
| 5,561,935 | 10/1996 | McCarthy et al. | 42/70.07 |
| 5,564,211 | 10/1996 | Mossberg et al. | 42/70.11 |
| 5,704,151 | 1/1998 | West et al. | 42/70.07 |
| 5,713,149 | 2/1998 | Cady et al. | 42/70.06 |
| 5,715,623 | 2/1998 | Mackey, III | 42/1.01 |
| 5,720,193 | 2/1998 | Dick | 70/298 |

FOREIGN PATENT DOCUMENTS

| | | | |
|---|---|---|---|
| 2505604 | 8/1976 | Germany | 42/70.07 |
| 3446019 | 6/1986 | Germany | 42/70.07 |

*Primary Examiner*—Michael J. Carone
*Assistant Examiner*—Son T. Nguyen
*Attorney, Agent, or Firm*—Stephen R. Greiner

[57] ABSTRACT

The trigger cover includes a housing having a clamp for secure attachment to the trigger guard of a firearm. Within the housing is an electrical circuit having a receiver energized by movement of a motion sensor. The receiver is coupled to a central processing unit which, upon receiving a signal from a remote transmitter, will energize a motor or solenoid to permit the spring-driven motion of a pair of guard plates which normally block access to the firearm trigger. The transmitter of the predetermined radio code may be worn as part of a piece of jewelry.

11 Claims, 3 Drawing Sheets

TRIGGER COVER FOR FIREARM

FIELD OF THE INVENTION

The present invention relates generally to firearms and safety mechanisms therefor.

BACKGROUND OF THE INVENTION

Each year, about 1,500 children in the United States are rushed to hospital emergency rooms with accidental gunshot injuries. Nearly 200 children died from such wounds in 1994. Surprisingly, experts continue to suggest that firearm owners should not use conventional trigger locks on firearms they keep loaded for protection since rapid use of a such firearm in an emergency is not possible.

In an effort to provide a firearm owner with quicker access to a firearm, yet prevent others from gaining unauthorized access, specialized firearm safes have been proposed. These safes generally include receptacles for securely receiving one or more firearms. Because of their relatively small size, firearm safes are easily carried off by children, thieves and others unless such are mounted upon immovable objects. Once mounted in place, however, some users find it difficult, especially in the dark, to manipulate the combination locks of their safes to gain access to their firearms.

SUMMARY OF THE INVENTION

In light of the problems associated with the known means for preventing accidental or unintended access to a firearm, it is a principal object of the invention to provide a trigger cover which grants access to the trigger of a firearm to an authorized user yet denies such access to all others. Thus, an individual who wrongfully comes into possession of a firearm protected with the invention would find the firearm's trigger to be inaccessible and the firearm inoperative.

It is another object of the invention to provide a trigger cover of the type described that can be easily attached to existing firearms without any modification of the firearm being required. All types of firearms such as: handguns, rifles, and shotguns may be accommodated by the inventive trigger cover.

It is an object of the invention to provide improved elements and arrangements thereof in a trigger cover for the purposes described which is lightweight in construction, dependable in use, and inexpensive to manufacture.

Briefly, the trigger cover in accordance with this invention achieves the intended objects by featuring a housing having a clamp for attachment to the trigger guard of a firearm. Within the housing is an electrical circuit having a receiver energized by movement of a motion sensor. The receiver is coupled to a central processing unit which, upon receiving a signal from a remote transmitter via the receiver, will energize a motor or solenoid. The motor or solenoid permit the spring-driven movement of a pair of guard plates from their protective positions blocking access to the firearm trigger to positions allowing access to the trigger.

The foregoing and other objects, features and advantages of the present invention will become readily apparent upon further review of the following detailed description of the preferred embodiments as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENTS

Figure 1:
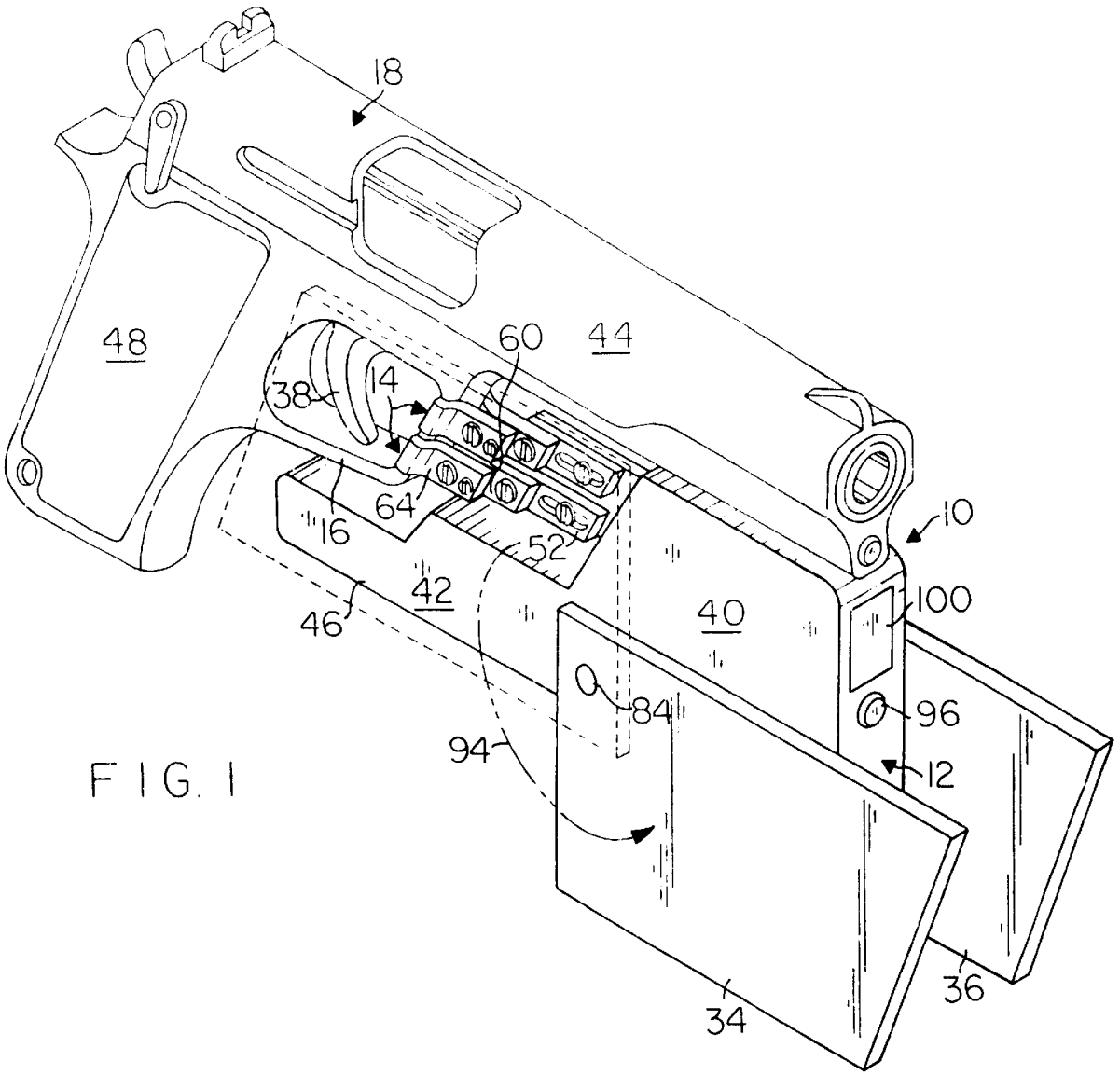
FIG. 1 is a perspective view of a trigger cover in accordance with the present invention shown secured to a firearm and having its guard plates pivoted forwardly to a position remote from the firearm's trigger.
Figure 2:
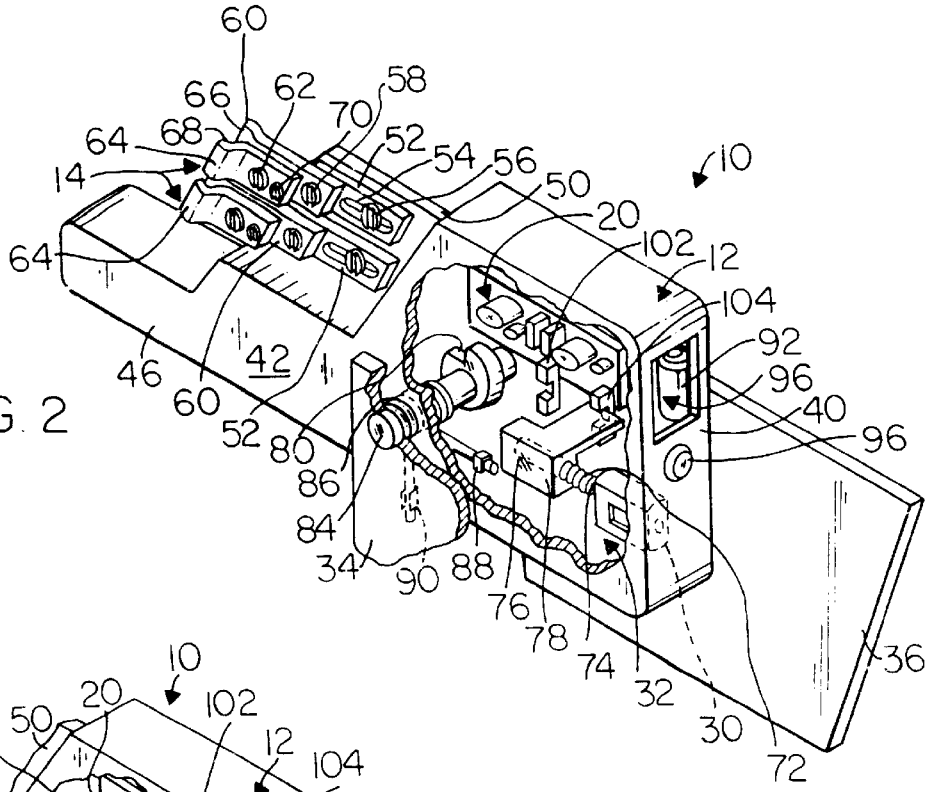
FIG. 2 is a perspective view of the trigger cover of FIG. 1 with pieces thereof broken away to reveal interior details and with its guard plates pivoted forwardly.
Figure 3:
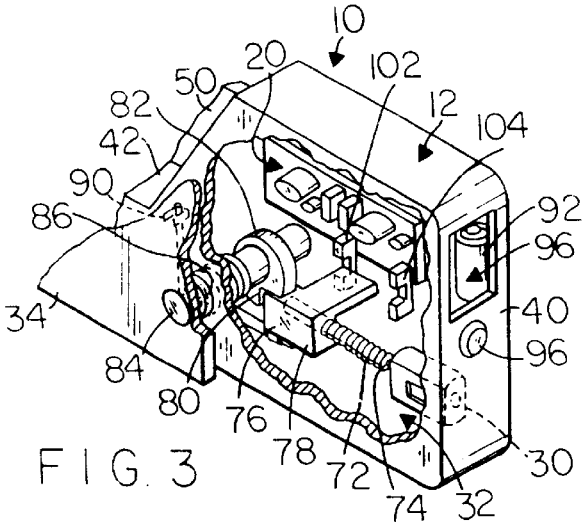
FIG. 3 is a perspective view of the trigger cover of FIG. 1 with pieces broken away and having its guard plates pivoted rearwardly to a trigger-covering position.
Figure 4:
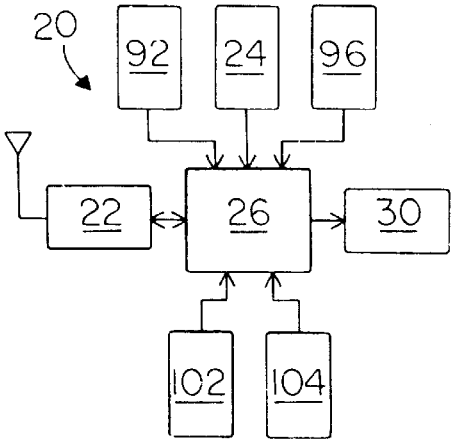
FIG. 4 is a schematic diagram showing the electrical circuit of the trigger cover of FIGS. 1 and 6.
Figure 5:
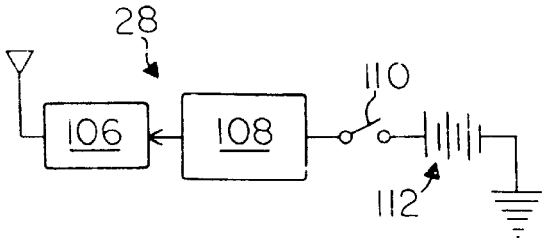
FIG. 5 is a schematic diagram showing the electrical circuit of a transmitter device used with the cover of FIGS. 1 and 6.

Referring now to FIGS. 1–5, a trigger cover in accordance with the present invention is shown at 10. The trigger cover 10 includes a housing 12 having a pair of clamps 14 for attachment to the trigger guard 16 of a firearm 18. Within the housing 12 is an electrical circuit 20 having a radio receiver 22 which is energized by movement of a motion sensor 24. The receiver 22 is coupled to a central processing unit (CPU) 26 which, upon receiving a predetermined signal from a remote transmitter device 28 via the receiver 22, energizes a motor 30. The motor 30 drives a mechanical linkage 32 which operates to pivotally move a pair of guard plates 34 and 36 away from their protective positions on opposite sides of trigger 38.

The housing 12 is integrally formed of a durable, metallic alloy and includes a hollow, forward portion 40 and a solid, rearward portion 42. As shown, the forward portion 40 is sized to fit compactly beneath the barrel 44 of firearm 18 and supports the circuit 20, linkage 32 and guard plates 34 and 36. The rearward portion 42, however, has an arm 46 which extends from the forward portion 40 toward the firearm grip 48 and beneath the trigger guard 16 so as to impede access to the trigger 38 from below. A finger 50 projects upwardly from the arm 46 and retains the clamps 14.

Each clamp 14 includes a slide 52 having a longitudinal slot 54. A threaded fastener 56 passes through the slot 54 and is secured to the finger 50. A second threaded fastener 58 secures a pivoting jaw 60 to the rear of the slide 52. A third threaded fastener 62 secures an articulating jaw 64 to the pivoting jaw 60. The jaws 60 and 64 have concave portions 66 and 68 at their rear ends which may be drawn together by a fourth threaded fastener 70 extending through the front of jaw 64 and pressing against jaw 60.

The clamps 14 permit cover 10 to be affixed to firearms of varied dimensions. To do this, fasteners 56, 58, 62 and 70 are loosened to permit: slides 52 to move forward and rearward relative to fingers 50, jaws 60 to pivot relative to slides 52, and jaws 64 to move toward jaws 60. With concave portions 66 and 68 positioned on opposite sides of trigger guard 16 and the top of forward portion 40 located adjacent barrel 44, fasteners 56, 58, 62 and 70 are fully retightened to secure cover 10 to firearm 18.

The guard plates 34 and 36 are preferably formed from a durable, metallic alloy. Each of the plates 34 and 36 is substantially rectangular in outline and has an overall length and height which are about the same as the rearward portion 42 of the housing 12. During use, when the guard plates 34 and 36 are pivoted to their protective positions, neither the trigger 38 nor the clamps 14 can be accessed thereby making it difficult for an unauthorized person to discharge the firearm 18 or remove the cover 10 therefrom.

Inside the housing 12, a worm gear 72 is affixed to a drive shaft 74 extending from the motor 30. The worm gear 72 is fitted within a threaded socket 76 in a slide 78. When the shaft 74 is rotated by the motor 30, the slide 78 is moved axially on the gear 72.

The slide 78 may be positioned by means of worm gear 72 in a notch 80 in a cam 82. The cam 82 is supported by a cam shaft 84 whose opposite ends protrude from the sides of the forward portion 40 of housing 12 and carry guard plates 34 and 36. A spring 86 is wound around the cam shaft 84 and has one end secured by an anchor 88 to the forward portion 40 and another end secured by an anchor 90 to guard plate 34. Energy stored by spring 86 may be utilized to pivot guard plates 34 and 36 away from trigger 38.

The motion detector 24 senses the lifting, jostling or other movement of the cover 10 and firearm 18. When movement is sensed, the detector 24 provides CPU 26 with an electrical current signal which causes the CPU to connect the receiver 22 to battery 92. If the receiver 22 receives the predetermined signal from the transmitter device 28, an electrical current signal will be sent to CPU 26 which, in turn, will energize the motor 30 by connecting such to the battery 92 to pull the slide 78 from the notch 80 in cam 82. Once done, the coiled spring 86 is free to pivot guard plates 34 and 36 on cam shaft 84 away from trigger 38 as indicated by arc 94 shown in FIG. 1. If the signal is not received from the transmitter device 28, a timer within CPU 26, will, after a few seconds, disconnect receiver 22 from battery 92 to conserve power.

Movement of the guard plates 34 and 36 to their protective positions on opposite sides of the trigger 38 is done by manually rotating such against the force of the spring 86. Once in their protective positions, the guard plates 34 and 36 are locked in place by pressing the locking button 96 on the front of the housing 12. The locking button 96 is an electrical switch which serves to deliver an electrical current signal to CPU 26 which energizes the motor 30 by appropriately connecting such to battery 92 so as to drive the slide 78 into the notch 80 in cam 82.

Adjacent the locking button 96, in the front of the housing 12, is an opening 98 for access to the battery 92. Such an opening 96 makes replacement of the battery 92 easy in the event of its failure. The opening 98 may be covered by a cover plate 100 to prevent dirt and moisture from entering the housing 12.

Excess wear to the motor 30 is prevented by photomicrosensors 102 and 104. The photomicrosensors 102 and 104, located at the forward and rearward ends of movement of the slide 78, send electrical current signals to the CPU 26 when the slide 78 passes between the emitter and detector portions at the top and bottom of each. When such a signal is received by the CPU 26, electrical current flow from the battery 92 to the motor 30 is terminated.

The dime-sized transmitter device 28 may be incorporated into a piece of jewelry such as watch (not shown). The transmitter 106 has a broadcast range of a few feet and sends a unique signal periodically—broadcast intervals on the order of 0.5 to 1 second are set by an associated central processing unit 108. A manual on/off switch 110 is used to control the overall time that broadcasts will be made by selectively connecting the transmitter 106 and CPU 108 to a battery 112. If desired, a single transmitter device 28 can be used to operate a plurality of trigger covers 10 simultaneously if the CPU 26 of each is programmed to receive the same signal to move their associated guard plates 34 and 36.

Use of the trigger cover 10 is straightforward. Motion of the firearm 18 and attached cover 10 energizes the receiver 22. If a predetermined signal from the transmitter device 28 is received, the CPU 26 will cause the guard plates 34 and 36 to rotate and expose the trigger 38 thereby enabling the firearm 18 to fire. If no signal is received from the transmitter device 28, the trigger 38 will remain covered by the guard plates 34 and 36, and the receiver 22 will be de-energized by the CPU 26 in about ten seconds. If anyone other than an authorized user possessing the transmitter device 28 handles the firearm 18, he will find it impossible to access the trigger 38 and fire the firearm.

When the access to the trigger 38 of the firearm 18 is no longer needed, the guard plates 34 and 36 are manually rotated to their protective positions adjacent the trigger 38 and the locking button 96 is pressed. The latter action causes the slide 78 to be moved to its locked position within the notch 80 in cam 82. The entire process of uncovering and covering the trigger 38 requires only a few seconds to complete and can be performed without looking at either cover 10 or firearm 18.

Figure 6:
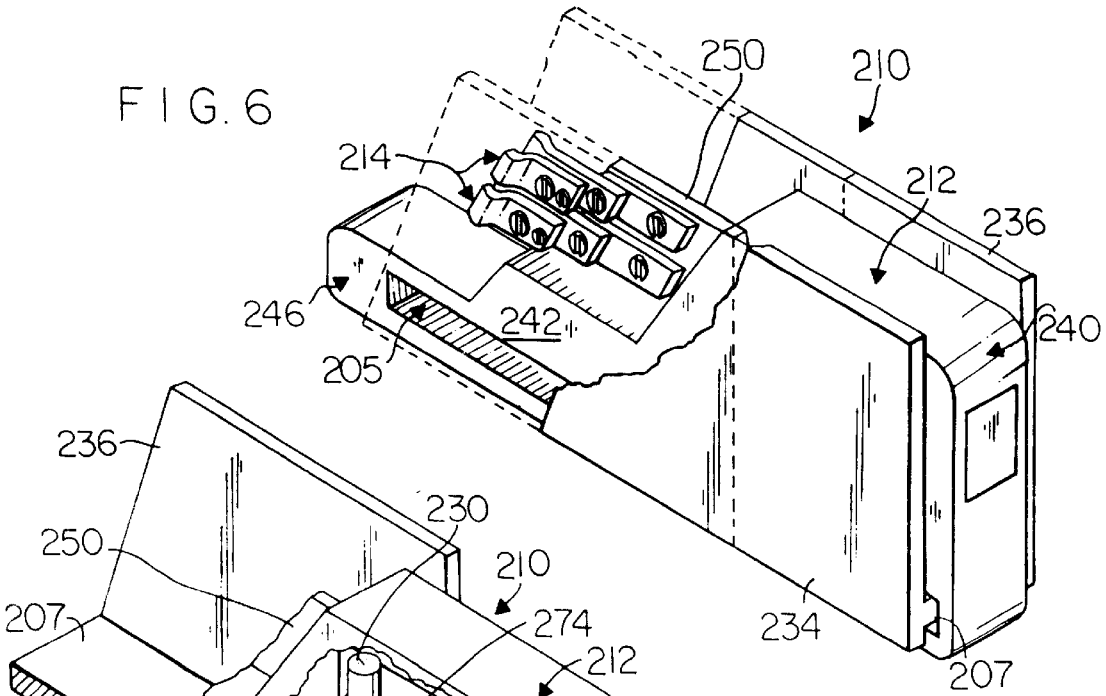
FIG. 6 is a perspective view of another embodiment of a trigger cover in accordance with the present invention.
Figure 7:
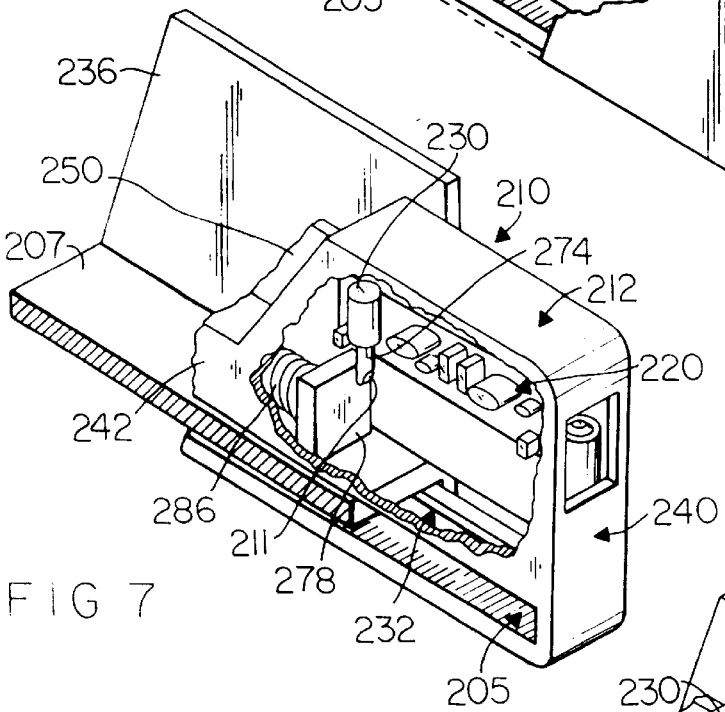
FIG. 7 is a perspective view of the trigger cover of FIG. 6 with pieces thereof broken away to reveal interior details and having its guard plates oriented in a trigger-covering position.
Figure 8:
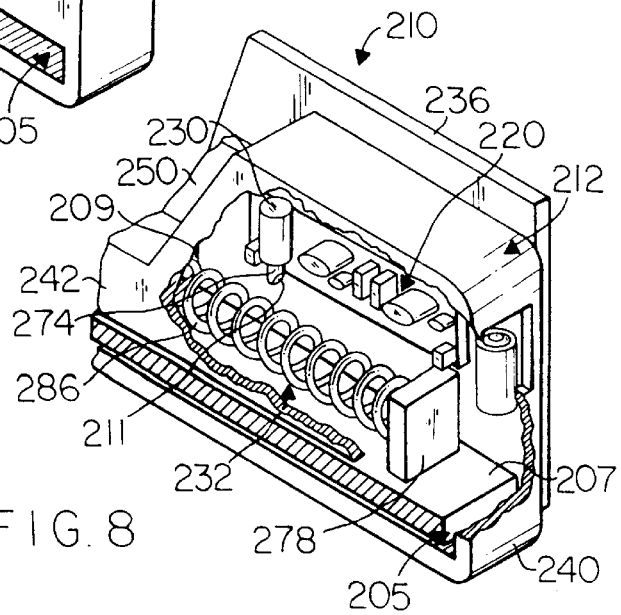
FIG. 8 is a perspective view of the trigger cover of FIG. 6 with pieces thereof broken away and having its guard plates moved forwardly to a position remote from a firearm trigger.

Referring now to FIGS. 6–8, an alternative embodiment of the trigger cover is illustrated generally at 210. The trigger cover 210 includes elements that correspond generally to those of cover 10 described above and will, thus, not receive belabored treatment below. Nonetheless, the cover 210 has modifications which permit its guard plates 234 and 236 to move linearly rather than pivot-these modifications will, of course, be discussed in detail.

The cover 210 includes a housing 212 having clamps 214 for attachment to the trigger guard of a firearm (not shown). Within the housing 212 is an electrical circuit 220 (whose features are substantially identical to those illustrated in FIG. 4 except that a solenoid 230 is substituted for motor 30) having a receiver 22 energized by movement of a motion sensor 24. The receiver 22 is coupled to a CPU 26 which, upon receiving a signal from a transmitter device 28 via the receiver, energizes solenoid 230. The energized solenoid 230 retracts its plunger 274 so as to disengage from a slide 278 affixed to guard plates 234 and 236. Thus disengaged, a compressed spring 286 drives the slide 278 and guard plates 234 and 234 forward to expose a firearm trigger.

The housing 212 includes forward and rearward portions 240 and 242. The forward portion 240 supports circuit 220, linkage 232 (which plunger 274, slide 278 and spring 286 form a part) and guard plates 234 and 236. The rearward portion 242, in contrast, has an arm 246 extending rearwardly from forward portion 240. The arm 246 has an upwardly projecting finger 250 which serves to retain clamps 214. The arm 246 also has a slot 205 which extends from its rear end to a point near the front end of forward portion 240.

A cross member 207 extends through the slot 205 and connects the bottoms of the guard plates 234 and 236 together. The slide 278 extends upwardly from the front end of the cross member 207 and into the forward portion 240 of the housing 212. The slide 278 serves as a forward abutment for the compressed spring 286. The rear abutment of the spring 286 is the front end 209 of the rearward portion 242. Energy stored by spring 286 may be utilized to linearly drive guard plates 234 and 236 forward and away from a firearm trigger.

As was noted above with respect to circuit 20, motion detector 24 provides CPU 26 with an electrical current signal which causes the CPU to connect the receiver 22 to battery 92 when motion is sensed. If the energized receiver 22 receives the predetermined signal from transmitter device 28, an electrical current signal is sent to CPU 26 which, in turn, energizes solenoid 230 by connecting such to battery 92 so as to disengage the plunger 274 from the slide 278. Once done, the spring 286 is free to push the slide 278 and attached guard plates 234 and 236 forward. If the signal is not received by the CPU 26 from receiver 22 within a few seconds, the solenoid 230 will not be energized and the CPU 26 will disconnect the receiver 22 from the battery 92.

Movement of guard plates 234 and 236 to their protective positions on opposite sides of a trigger is done by pushing such rearwardly against the force of the spring 286. The guard plates 234 and 236 are locked in place by the plunger 274 whose beveled front edge 211 permits such to move over the slide 278 as it is pushed past during rearward movement. At their rearward limit of travel, the plates 234 and 236 prevent access to a firearm trigger and clamps 214.

Use of trigger cover 210 is substantially like that of trigger cover 10. Motion of cover 210 causes CPU 26 to energize receiver 22. If a predetermined signal from the transmitter device 28 is received, the CPU 26 will automatically energize the solenoid 230 to retract plunger 274 and release slide 278. The compressed spring 286 will move the slide 278 and guard plates 234 and 236 forward to expose a trigger. If no signal is received from transmitter device 28, then the trigger will remain covered by plates 234 and 236 and receiver 22 will be de-energized by the CPU 26. In use, both trigger cover 10 and 210 automatically grant access to the trigger of a firearm to an authorized user yet deny access to all others.

While the invention has been described with a high degree of particularity, it will be appreciated by those skilled in the art that modifications may be made thereto. Therefore, it is to be understood that the present invention is not limited to the pair of embodiments described above, but encompasses any and all embodiments within the scope of the following claims.

We claim:

1. A trigger cover for a firearm having a trigger and a trigger guard, said trigger cover comprising:

a housing having a clamp for attachment to the trigger guard;

an electrical circuit within said housing, said electrical circuit including:

a central processing unit;

a motion sensor for detecting changes in the position of said housing with respect to time and for signaling said central processing unit when changes in position with respect to time are sensed;

a receiver for detecting a radio signal from a remote transmitter and signaling said central processing unit when said radio signal is received, said receiver being energized by said central processing unit when said central processing unit is signaled by said motion sensor;

a pair of guard plates movably secured to said housing and adapted to prevent access to the trigger of the firearm; and, means, operatively connected to said central processing unit, for moving said guard plates when said central processing unit is signaled by said receiver.

2. The trigger cover according to claim 1 wherein said moving means includes:

a motor operatively connected to said central processing unit and having a rotatable drive shaft, said motor being energized, so as to rotate said drive shaft, by said central processing unit when said central processing unit is signaled by said receiver;

a mechanical linkage positioned substantially within said housing and coupled to said drive shaft of said motor, said linkage including:

a worm gear affixed to said drive shaft;

a slide having a threaded socket for receiving said worm gear therein such that when said drive shaft is rotated by said motor, said slide is moved axially on said worm gear;

a rotatable cam shaft oriented perpendicularly to said drive shaft and having opposed ends extending outwardly through the sides of said housing;

a cam affixed to said cam shaft, said cam having a notch therein for receiving said slide so as to selectively prevent the rotation of said cam shaft; and, a spring wound on said cam shaft adjacent said cam, said spring having opposite ends, one of said opposite ends being anchored to said housing, the other of said opposite ends extending outwardly through one side of said housing adjacent said cam shaft; and, said guard plates each being respectively affixed to one of said opposed ends of said cam shaft, each of said guard plates also being sized to prevent access to the trigger and the trigger guard when said slide is selectively received within said notch in said cam, one of said guard plates being secured to said end of said spring extending outwardly through said housing whereby energy stored by said spring may be utilized to pivot said guard plates away from the trigger and trigger guard when said slide is removed from said notch in said cam.

3. The trigger cover according to claim 1 wherein said housing has a longitudinal slot remote from said clamp and said moving means includes:

a solenoid operatively connected to said central processing unit and having a retractable plunger, said solenoid being energized, so as to retract said plunger, by said central processing unit when said central processing unit is signaled by said receiver;

a mechanical linkage coupled to said plunger, said linkage including:

a cross member being slidably positioned within said slot and having opposed ends extending therefrom;

a slide secured to said cross member and extending upwardly therefrom within said housing, said slide being adapted for selective engagement with the side of said plunger adjacent the trigger; and, a compressed spring abutting said slide for driving said slide away from the trigger; and, a pair of guard plates, each being respectively affixed to one of said opposed ends of said cross member, each of said guard plates being sized to prevent access to the trigger and the trigger guard when said slide is selectively engaged with the side of said plunger adjacent the trigger.

4. The trigger cover according to claim 1 wherein said clamp includes:

a pivoting jaw having a first concave portion for receiving a portion of said trigger guard therein;

an articulating jaw, spaced from said pivoting jaw, having a second concave portion positioned opposite said first concave portion for receiving a portion of said trigger guard therein; and, a threaded fastener securing said articulating jaw to said pivoting jaw.

5. The trigger cover according to claim 1 wherein said housing has a rearward portion which extends beneath the trigger guard to prevent access to the trigger from below.

6. A trigger cover for a firearm having a trigger and a trigger guard, said trigger cover comprising:

a housing having a clamp for attachment to the trigger guard;

an electrical circuit within said housing, said electrical circuit including:

a central processing unit;

a motion sensor for detecting changes in the position of said housing with respect to time and for signaling said central processing unit when changes in position with respect to time are sensed;

a receiver for detecting a radio signal from a remote transmitter and signaling said central processing unit when said radio signal is received, said receiver being energized by said central processing unit when said central processing unit is signaled by said motion sensor; and, a motor operatively connected to said central processing unit and having a rotatable drive shaft, said motor being energized, so as to rotate said drive shaft, by said central processing unit when said central processing unit is signaled by said receiver;

a mechanical linkage positioned substantially within said housing and coupled to said drive shaft of said motor, said linkage including:

a worm gear affixed to said drive shaft;

a slide having a threaded socket for receiving said worm gear therein such that when said drive shaft is rotated by said motor, said slide is moved axially on said worm gear;

a rotatable cam shaft oriented perpendicularly to said drive shaft and having opposed ends extending outwardly through the sides of said housing;

a cam affixed to said cam shaft, said cam having a notch therein for receiving said slide so as to selectively prevent the rotation of said cam shaft; and, a spring wound on said cam shaft adjacent said cam, said spring having opposite ends, one of said opposite ends being anchored to said housing, the other of said opposite ends extending outwardly through one side of said housing adjacent said cam shaft; and, a pair of guard plates, each being respectively affixed to one of said opposed ends of said cam shaft, each of said guard plates being sized to prevent access to the trigger and the trigger guard when said slide is selectively received within said notch in said cam, one of said guard plates being secured to said end of said spring extending outwardly through said housing whereby energy stored by said spring may be utilized to pivot said guard plates away from the trigger and trigger guard when said slide is removed from said notch in said cam.

7. The trigger cover according to claim 6 wherein said clamp includes:

a slide having a longitudinal slot and abutting said housing;

a first threaded fastener passing through said longitudinal slot and secured to said housing;

a pivoting jaw abutting said slide, said pivoting jaw having a first concave portion remote from said slide for receiving a portion of said trigger guard therein;

a second threaded fastener securing said pivoting jaw to said slide at a location remote from said slot;

an articulating jaw spaced from said pivoting jaw, said articulating jaw having a second concave portion positioned opposite said first concave portion for receiving a portion of said trigger guard therein;

a third threaded fastener securing said articulating jaw to said pivoting jaw; and, a fourth threaded fastener extending through said articulating jaw and pressing against the pivoting jaw.

8. The trigger cover according to claim 6 wherein said housing has a rearward portion which extends beneath the trigger guard to prevent access to the trigger from below.

9. A trigger cover for a firearm having a trigger and a trigger guard, said trigger cover comprising:

a housing having a clamp for attachment to the trigger guard and a longitudinal slot remote from said clamp;

an electrical circuit within said housing, said electrical circuit including:

a central processing unit;

a motion sensor for detecting changes in the position of said housing with respect to time and for signaling said central processing unit when changes in position with respect to time are sensed;

a receiver for detecting a radio signal from a remote transmitter and signaling said central processing unit when said radio signal is received, said receiver being energized by said central processing unit when said central processing unit is signaled by said motion sensor; and, a solenoid operatively connected to said central processing unit and having a retractable plunger, said solenoid being energized, so as to retract said plunger, by said central processing unit when said central processing unit is signaled by said receiver;

a mechanical linkage coupled to said plunger, said linkage including:

a cross member being slidably positioned within said slot and having opposed ends extending therefrom;

a slide secured to said cross member and extending upwardly therefrom within said housing, said slide being adapted for selective engagement with the side of said plunger adjacent the trigger; and, a compressed spring abutting said slide for driving said slide away from the trigger; and, a pair of guard plates, each being respectively affixed to one of said opposed ends of said cross member, each of said guard plates being sized to prevent access to the trigger and the trigger guard when said slide is selectively engaged with the side of said plunger adjacent the trigger.

10. The trigger cover according to claim 9 wherein said clamp includes:

a slide having a longitudinal slot and abutting said housing;

a first threaded fastener passing through said longitudinal slot and secured to said housing;

a pivoting jaw abutting said slide, said pivoting jaw having a first concave portion remote from said slide for receiving a portion of said trigger guard therein;

a second threaded fastener securing said pivoting jaw to said slide at a location remote from said slot;

an articulating jaw spaced from said pivoting jaw, said articulating jaw having a second concave portion positioned opposite said first concave portion for receiving a portion of said trigger guard therein;

a third threaded fastener securing said articulating jaw to said pivoting jaw; and, a fourth threaded fastener extending through said articulating jaw and pressing against the pivoting jaw.

11. The trigger cover according to claim 9 wherein said housing has a rearward portion which extends beneath the trigger guard to prevent access to the trigger from below.

* * * * *